US006056225A

United States Patent [19]

David et al.

[11] Patent Number: 6,056,225

[45] Date of Patent: May 2, 2000

[54] APPARATUS FOR HANDLING WIRE ROD FROM A LAYING HEAD OR LAYING CONE

[75] Inventors: Siegfried David; Karl Keller, both of Hilchenbach, Germany

[73] Assignee: Sms Schoemann-Siemag, Dusseldorf, Germany

[21] Appl. No.: 09/205,500

[22] Filed: Dec. 4, 1998

[30] Foreign Application Priority Data

Dec. 5, 1997 [DE] Germany ..... 197 54 081

[51] Int. Cl.[7] ..... B21C 47/24

[52] U.S. Cl. ..... 242/363; 242/361.4; 242/362

[58] Field of Search ..... 242/363, 360, 242/361, 361.4, 362

[56] References Cited

U.S. PATENT DOCUMENTS

| | | | |
|---|---|---|---|
| 3,405,885 | 10/1968 | Schroder et al. | 242/363 X |
| 3,460,777 | 8/1969 | Schroder | 242/363 X |
| 3,469,798 | 9/1969 | Schroder | 242/363 X |
| 5,634,607 | 6/1997 | Poloni | 242/363 |
| 5,775,617 | 7/1998 | Poloni | 242/363 |
| 5,826,812 | 10/1998 | Hand | 242/363 |

FOREIGN PATENT DOCUMENTS

| | | | |
|---|---|---|---|
| 1294321 | 5/1969 | Germany | 242/363 |
| 250069 | 9/1987 | Germany | 242/363 |
| 4021290 | 9/1969 | Japan | 242/363 |

*Primary Examiner*—Donald P. Walsh
*Assistant Examiner*—William A. Rivera

[57] ABSTRACT

A winding cone in a high speed wire rod rolling mill has a replaceable glide shell which is suspended by a cable and can be dropped into the mounting pockets on opposite sides of the winding cone. By changing the angle of conicity of the glide shell and its length, i.e. by substituting a differently dimensioned glide shell between winding cone and the cooling conveyor, a change in the coiling program can be facilitated.

10 Claims, 2 Drawing Sheets

APPARATUS FOR HANDLING WIRE ROD FROM A LAYING HEAD OR LAYING CONE

FIELD OF THE INVENTION

The present invention relates to an apparatus for handling wire rod from a high speed rod mill downstream of a laying head or laying cone and, more particularly, to an apparatus for tilting wire rod turns formed in an eye-vertical or eye-upright position into an eye-recumbent position in spencerian coils, i.e. coils of overlapping turns, on a cooling conveyor.

BACKGROUND OF THE INVENTION

In a rod mill, especially in a high speed wire rod mill, the wire rod is normally fed to a laying head or cone in which the wire rod, coming from the earlier mill stages in a longitudinal direction, is deflected to form turns which are generally upright and are referred to as eye-vertical turns. The wire rod turns are then fed to a cooling station, generally on a conveyor which may be a belt or roller conveyor.

Downstream of the conveyor, the turns are gathered into a coil and the coils in readily transportable sizes, are tied or otherwise secured against spreading of the turns, stacked or otherwise stored or transported.

Because of the high wire rod speed in a high speed rod mill, the deflection of the wire rod at the end of the linear path from a horizontal travel to a vertical travel is practically impossible. As a consequence, in the laying head or cone, the wire rod is deflected into a succession of turns which are more or less upright as noted and at the output side of the laying head or cone, the eye-vertical or upright turns are laid down in horizontal turns which are horizontally fanned apart but nevertheless overlapped. That turn pattern is referred to as a spencerian coil. The wire rod in the spencerian coil can be cooled in an optimum manner. In the past, the system for spreading out the turns of coiled wire rod in a mill line has been characterized by a number of drawbacks or disadvantages and the high cost of the equipment provided therefore.

German open application 28 37 912 describes an apparatus for depositing and spreading wire rod turns on a transport conveyor which serves as a cooling stretch. The device comprises a conveyor which can be tilted upwardly at an upstream section and a laying cone which has its axis of rotation inclined at an acute angle to the horizontal. The tiltable first section of the transport conveyor which has a pivot axis located at a point spaced from the region in which the coil turns are deposited, enables variation of the height through which the turns from the laying cone can fall onto the conveyor. The laying cone has a laying pipe whose pitch can be altered to enable variation in the outlet speed of the turns which are formed and thus the characteristic of the ballistic laying curve. As a result of these features, the turns as they deposit upon the conveyor are tilted onto the latter free from any braking effect of the conveyor belt. It is, however, a disadvantage of this system for spreading and depositing the wire rod turns that the system is somewhat more complex to construct and more expensive to control if the characteristic of the ballistic laying curve of the turns is to be regulated.

OBJECTS OF THE INVENTION

It is the principal object of the present invention to provide a simple and uncomplicated device for tilting rod turns downstream of a winding head, laying head or laying cone in a rod mill, especially in a high speed wire rod mill, whereby the wire turns can be formed more cleanly and deposited more cleanly and reliably on the conveyor.

Another object of the invention is to provide a device in a high speed wire rod mill line for the purposes described which can operate effectively with thin wire, since thin glowing wire is particularly sensitive to the effects of externally applied forces or reacts more readily with external materials.

SUMMARY OF THE INVENTION

These objects and others which will become apparent hereinafter are attained, in accordance with the invention in an apparatus for the tilting of wire rod turns downstream of a coiling head, laying head or laying cone, in a wire rod mill, especially a high speed wire rod mill whereby behind the laying head and ahead of the roller conveyor for receiving the turns, a glide sheet metal guide is provided for tilting the wire turns. According to the invention, the guide member is a glide shell which preferably has a conical cross section.

The length of the glide shell is dependent upon the rolling speed and has a length of say 100 to 500 mm. The radius of the glide shell should be greater than the radius of the turns.

The glide shell can be mounted on the winding head pivotally in pockets on opposite sides of the turn-forming head.

It has been found to be advantageous, moreover, to pivotally provide the glide shell with lateral suspension pins (trunnions) engageable in the mounting pockets. The pins each can be associated with a securing disk or washer preventing slipping of the mounting cable or wire from which the shell is suspended. The mounting wire or cable can be held on a hook.

The suspension point of the glide shell on the mounting hook can be so chosen that the glide shell is pressed by its weight against the winding and laying head. According to yet another feature of the invention, the cone angle, (i.e. the half angle $\alpha$) of the glide shell amounts to between 1° to 10°. The axis of the glide shell can be inclined relative to the central axis of the winding and laying head at an angle of 1° to 10°.

The glide shell has, as has already been noted, preferably a conical cross section and the length L of the glide shell in the coil depositing direction can be variable and can amount to between 100 mm and 500 mm. The length of the glide shell depends, as noted, on the rolling speed of the wire rod.

In the tilting, the turns must be braked but need not come to standstill. According to a further feature of the invention, the glide shell is not simply bolted onto the winding cone but rather is suspended therefrom in two mounting pockets which insures a short mounting time for the operation.

In a further feature of the invention, the suspension point for the glide shell on the mounting hook is so selected that the glide shell is pressed by its intrinsic weight into the seats formed by the mounting pockets. For that purpose, the glide shell may have a pair of trunnions which drop into these seats.

The radius of the glide shell is preferably greater than the turn radius so that the wire rod turns have some degree of lateral free space but are nevertheless supported from below and can be braked.

By providing different glide shells with different angles a and different lengths L, we can match the various different operating conditions which may arise.

In the case of a program change as may be necessary or desirable, only the glide shell itself need be replaced. All of the other components of the wire rod mill line, especially the winding head or winding cone, the cooling conveyor belt or roller conveyor and the like need not be replaced or structurally modified.

The apparatus, in its broadest form for tilting wire rod turns in a rod mill line can thus comprise:

a laying head in the rod-mill line receiving oncoming wire rod and forming the wire rod into eye-upright turns;

a roller conveyor downstream of the laying head for carrying the turns away; and a sheet-metal guide between the laying head and the roller conveyor for tipping the eye-upright turns into eye-recumbent turns and depositing the turns overlappingly on the roller conveyor.

BRIEF DESCRIPTION OF THE DRAWING

The above and other objects, features, and advantages will become more readily apparent from the following description, reference being made to the accompanying drawing in which.

SPECIFIC DESCRIPTION

The apparatus of the invention is fitted to a high speed wire rod rolling line in which thin wire rod 1 is supplied to a winding head or cone 2 and leaves the wire cone 2 with a horizontal speed which is determined by the product of the peripheral speed of the laying pipe of the winding cone and the tangent of the output angle in accordance with the formula:

$$V_H = V_U * \tan \alpha$$

where $V_H$ is the horizontal velocity, $V_U$ is the peripheral speed of the laying tube and $\alpha$ is the outlet angle.

For example, the wire may emerge at a horizontal velocity of $$V_H = 120 \text{ m/s} * \tan 2^\circ = 4.2 \text{ m/s}$$

from the laying cone where the peripheral speed is 120 m/s and the discharge angle is 2°. This horizontal velocity is superimposed upon the increasing vertical velocity which is subject to gravitational acceleration, corresponding to a throwing parabola 4.

Figure 1:
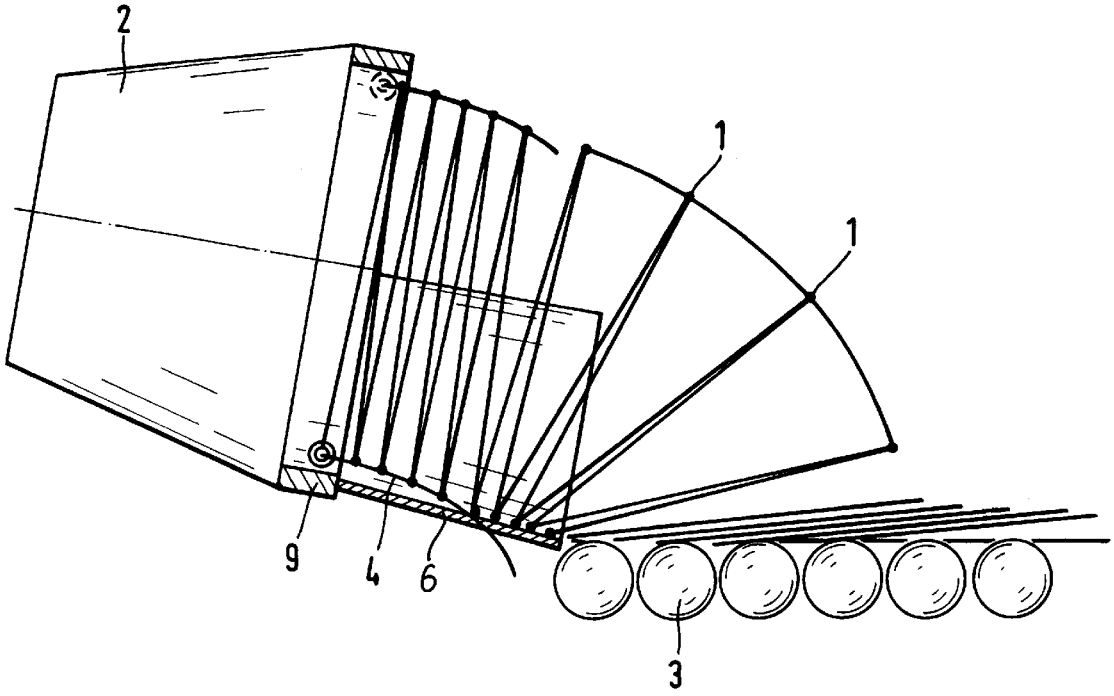
FIG. 1 is a diagrammatic cross sectional view, showing the apparatus from the side, illustrating a system using a glide shell between the winding cone and the roller conveyor.

The wire turns then meet the guide 6 which is formed as a glide shell along the underside of which the wire rod turns are braked and tilted (see FIG. 1). The turns are fanned out downstream of the glide shell 6 on the roller conveyer 3 in which the turns assume an eye-horizontal position from their original eye-vertical position in the winding cone.

Figure 2:
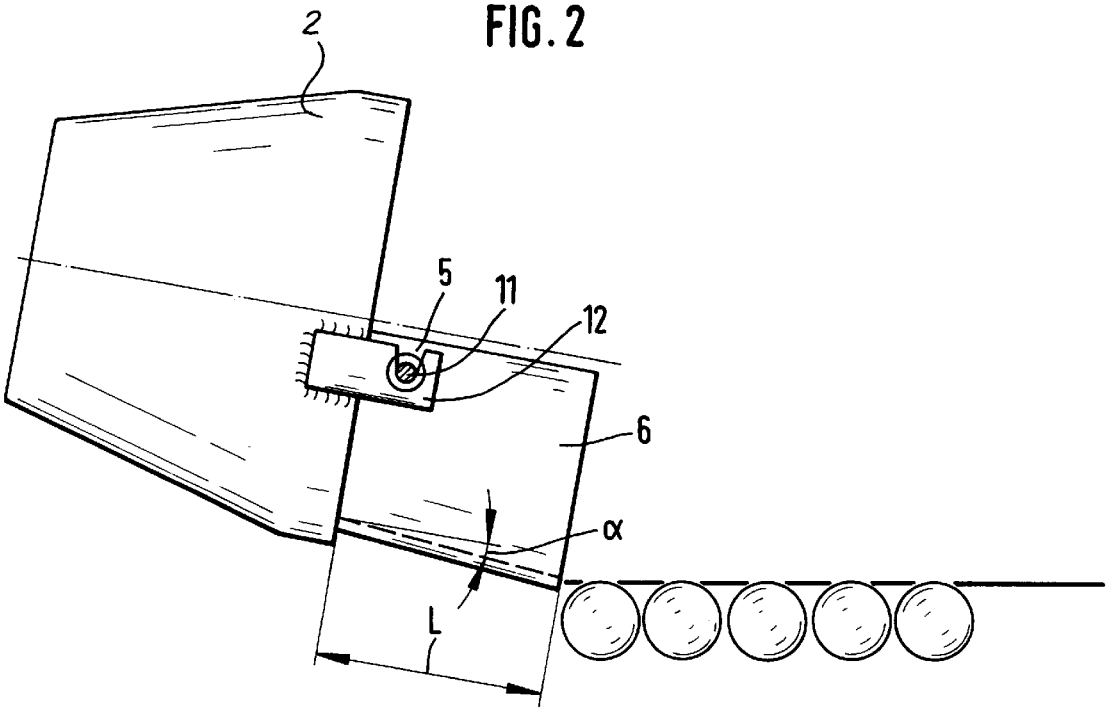
FIG. 2 is a side elevational view showing the mounting of the glide shell on the winding cone or winding head.

FIG. 2 shows that the glide shell 6 is provided with laterally projecting trunnions 11 which are cradled in mounting pockets 5 formed in holders 12 projecting axially from the laying head 2 and rigid therewith.

Figure 3:
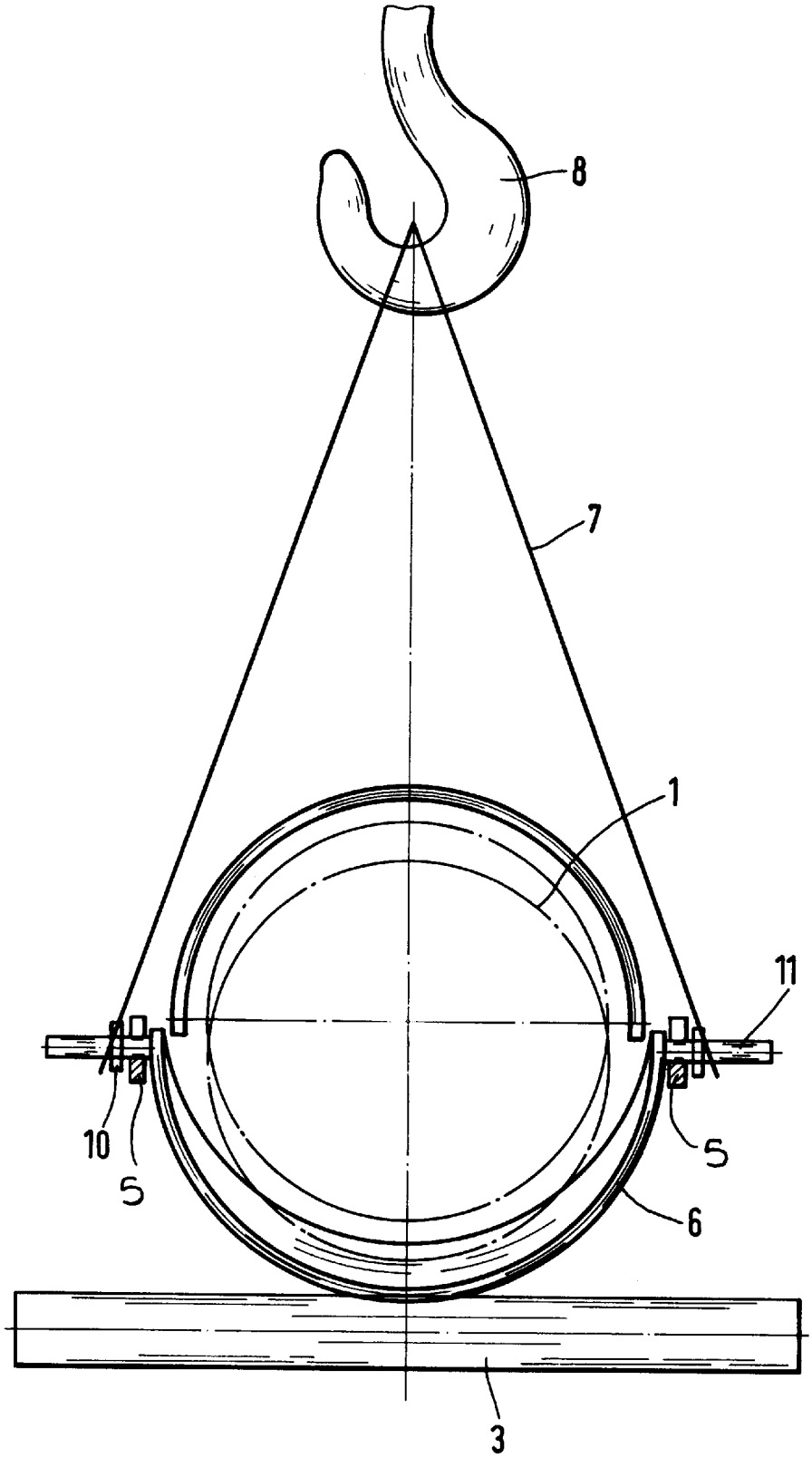
FIG. 3 is a front elevational view illustrating the positioning of the glide shell trunnions in the pockets of the winding cone.

From FIG. 3 it will be apparent that the glide shell 6 can be lowered by a mounting cable with a hook 8, the mounting cable engaging the trunnions 11. Washers 10 limit the inward movement of the loops of the cable 7 along the trunnions 11.

The specific gravity of the glide shell 6 and the point at which the cable 7 is suspended from the hook 8 are so selected that the glide shell always rests with its weight in the pockets and abuts the protective hood 9 of the laying cone 2. These forces are always greater than the frictional forces which are applied by the wire rod turns to the glide shell 6.

The radius R of the glide shell 6 is preferably greater than the radius of the wire turns 1 so that the wire turns 1 will have some freedom of movement relative to the glide shell and will not jam in or against the glide shell and thus will not be damaged thereby.

Because the invention allows the use of different glide shells 6 with different conical angles a and different lengths L, practically any set of operating conditions can be achieved by a simple replacement of the glide shell.

With a program change as to the coiling of the wire rod, only the glide shell need be replaced.

We claim:

1. An apparatus for tilting wire-rod turns in a rod-mill line, comprising:

a laving head in said rod-mill line receiving oncoming wire rod and forming said wire rod into eye-upright turns;

a roller conveyor downstream of said laying head for carrying said turns away;

a sheet-metal guide between said laving head and said roller conveyor for tipping said eye-upright turns into eve-recumbent turns and depositing said turns overlappingly on said roller conveyor; and a pair of mounting pockets on said head supporting said glide shell.

2. The apparatus defined in claim 1 wherein said sheet-metal guide is a trough-shaped upwardly open glide shell of a conical cross section.

3. The apparatus defined in claim 2 wherein said glide shell has a conicity angle of 1° to 10°.

4. The apparatus defined in claim 1 wherein said glide shell has a length selected based upon a rolling speed of said mill between 100 mm and 500 mm.

5. The apparatus defined in claim 1 wherein said glide shell has a radius greater than that of the wire rod turns.

6. The apparatus defined in claim 1 wherein said glide shell is formed with laterally projecting trunnions seated in said pockets.

7. The apparatus defined in claim 6, further comprising at least one securing disk on each of said trunnions for preventing a mounting cable from slipping along the respective trunnion.

8. The apparatus defined in claim 7 wherein said mounting cable is suspended from a mounting hook.

9. The apparatus defined in claim 8 wherein a suspension point of said glide shell on said mounting hook is selected so that said glide shell presses by its own weight against said head.

10. The apparatus defined in claim 1 wherein said glide shell has an axis inclined relative to a central axis of said head downwardly toward said roller conveyor of 1° to 10°.

* * * * *